United States Patent [19]

Luxton et al.

[11] Patent Number: 4,952,616

[45] Date of Patent: Aug. 28, 1990

[54] BINDERS

[75] Inventors: Martin J. Luxton; William C. S. Meredith; Andrew Harrod, all of Kings Lynn, United Kingdom

[73] Assignee: Hepworth Minerals & Chemicals Limited, Sandbach, United Kingdom

[21] Appl. No.: 271,499

[22] Filed: Nov. 15, 1988

[30] Foreign Application Priority Data

Nov. 18, 1987 [GB] United Kingdom ..... 8727018

[51] Int. Cl.[5] ..... C08L 33/02; C08K 3/34

[52] U.S. Cl. ..... 523/141; 523/139; 524/556; 525/330.2; 525/386

[58] Field of Search ..... 523/139, 141; 106/38.2; 164/15, 16, 525, 527; 524/556; 525/330.2, 386

[56] References Cited

U.S. PATENT DOCUMENTS

| | | | |
|---|---|---|---|
| 4,106,944 | 8/1978 | Epstein | 523/139 |
| 4,269,256 | 5/1981 | Nakazawa et al. | 523/139 |
| 4,495,980 | 1/1985 | Morley | 164/16 |
| 4,506,041 | 3/1985 | Tanigawa et al. | 523/139 |
| 4,588,013 | 5/1986 | Morley | 164/16 |
| 4,605,052 | 8/1986 | Morley | 523/139 |

*Primary Examiner*—Lewis T. Jacobs

*Attorney, Agent, or Firm*—Webb, Burden, Ziesenheim & Webb

[57] ABSTRACT

A foundry binder comprising an aqueous solution of sodium polyacrylate and calcium hydroxide is cured by the addition of a liquid ester.

12 Claims, No Drawings

BINDERS

BACKGROUND OF THE INVENTION

From a first aspect, the present invention relates to a method of curing a binder. The invention also embraces a binder composition, a foundry composition comprising a binder and a foundry aggregate and a consignment of compositions for use in the foundry composition. The invention relates primarily to binders suitable for use in a foundry for binding together particles of a foundry aggregate to form a core or a mould.

In GB No. 2,112,003A, there is disclosed a method of preparing a foundry core wherein there is mixed with a foundry aggregate calcium hydroxide and an aqueous solution of sodium polyacrylate, the mixture is formed to the required shape and carbon dioxide is passed through the mixture to cure the binder. However, use of carbon dioxide as the curing agent is not entirely satisfactory, in all circumstances. For example, it is inconvenient to cure by gasing with carbon dioxide single cores or small numbers of cores, when there is no long production run. It is also unsatisfactory to cure by gasing with carbon dioxide some large cores and moulds.

SUMMARY OF THE INVENTION

According to a first aspect of the present invention, we provide a method of curing a binder comprising a source of polyvalent cations and a source of anions of a polymeric and/or polybasic organic acid, wherein a curing agent in liquid form and comprising an ester is mixed with the binder.

The source of polyvalent cations may be an hydroxide or oxide of a polyvalent metal. By a polyvalent metal, we mean a metal having a valency of two or more. The source of polyvalent cations may be a salt of such a metal and may comprise compounds of two or more such metals.

The source of anions of a polymeric and/or polybasic organic acid may include a polymeric organic acid as the free acid, a salt or an ester of such an acid, a polybasic organic acid as the free acid or a salt or an ester of a polybasic organic acid. By the expression "a source of anions", we do not imply that the source must necessarily provide free anions in the curable, curing or cured binder. We mean that the source is a potential source of such anions. However, the source of anions is preferably such as to prvide anions in the reaction mixture, each anion having an electrovalence of at least two.

The preferred source of anions of a polymeric and/or polybasic organic acid is the sodium salt of the homopolymer of acrylic acid. However, it would be within the scope of the invention to substitute for some or all of the homo-polymer of acrylic acid a co-polymer of acrylic acid or a homo-polymer of a substituted acrylic acid, for example methacrylic acid, or a copolymer of a substituted acrylic acid. The organic material may have a molecular weight similar to that suggested in GB No. 2,112,003A.

The curing agent may comprise a single ester but a mixture of esters is preferred. The term ester, as used herein, embraces lactones and carbonates. The ester or esters comprised by the curing agent is or are preferably liquids at ambient temperatures. However, the curing agent may comprise a solvent or diluent which is not an ester and an ester which is not normally a liquid at ambient temperature may be present in solution.

Esters which may be used in the curing agent include butyrolactone, esters of glycerol and of other polyols, esters of mono and dibasic acid, propylene carbonate and ethylene carbonate.

DESCRIPTION OF EXAMPLES EMBODYING THE INVENTION

Core strengths achieved in a number of examples of curing of a binder by a method in accordance with the invention are set out hereinafter in tables 1,2 and 3, being expressed in $Kgfcm^{-1}$. In each of these examples, the selected curing agent was mixed with two killograms of dry sand in a mixer for a period of one minute and the selected binder was then added and mixing continued for a further minute. At the end of this period, a number of sample cores were prepared from the mixture. These were standard AFS specimens of two inch diameter. The compressive strengths of specimen cores from each mix were measured after one, two, three and twenty four hours. Also, after twenty four hours, the surface hardness of one specimen from each mix was measured by use of a Ridsdale-Dietert core hardness meter. Tables 1 and 2 also include for almost all of the mixes an estimate in minutes of the set time, that is the shortest period following mixing which is necessary for the sample to acquire sufficient strength for a core of the same composition to be ejected from a core box or pattern plate and to be handled without suffering damage.

In each of the examples set out in tables 1,2 and 3 the sand used was Congleton HST20. In each of examples 1 to 19, the temperature of the sand was 20° C. and the ambient temperature was also maintained at 20° C. The relative humidity was 50%.

In example 20, the ambient temperature and the temperature of the sand were both 0° C. In example 21, the ambient temperature and the temperature of the sand were both 20° C. and in example 22, the ambient temperature and the temperature of the sand were both 30° C. These examples illustrate that the set times required at the two higher temperatures are approximately the same; whereas at 0° C. a much longer set time is required.

In example 24, preparation of the sample core was delayed for a period of five minutes after mixing. In example 25, formation of the specimen core was delayed for ten minutes after mixing and in example 26 preparation of the specimen core was delayed for fifteen minutes after mixing of the compositions. The same binder mix and curing agent, both being in the same proportions, were used in examples 23 to 26 inclusive. These results show that the bench life of the mix is in the region of 25% to 50% of the set time. By the bench life, we mean the length of time after mixing which is available before the setting process has rendered the composition unsuitable for the preparation of satisfactory moulds and cores. Example 26 shows that the bench life of the mix is exceeded if formation of the specimen core is delayed for fifteen minutes after mixing.

Binder mix A, which was used in examples 1,2 and 3 is formed by mixing with sixty seven parts of an aqueous solution of sodium polyacrylate (25% solids) twenty one parts of calcium hydroxide, ten parts of magnesium hydroxide and two parts of tri-calcium citrate, all parts being by weight. The binder mix is a slurry or suspension. Binder mix B used in examples 12 to 26 has a somewhat higher proportion of resin solids and lower proportions of the metallic hydroxides and the calcium citrate. Binder mix B is formed by mixing with 78.5 parts of aqueous sodium polyacrylate solution (28% solids) 14 parts of calcium hydroxide, 6 parts of magnesium hydroxide and 1.5 parts of calcium citrate. All parts are by weight.

Binder mixes C to G, used in examples 4 to 11, differ from binder mix A in that the solution of sodium polyacrylate constitutes a larger proportion, by weight, of the mixture than is the case in mix A. This proportion is 80%, 71%, 77%, 83% and 91% in binder mixes C,D,E,F and G respectively. The proportions of the other constituents are reduced correspondingly.

Binder mix 1, used in examples 30,31 and 32, comprises eighty five parts by weight of aqueous sodium polyacrylate solution (25% solids) and fifteen parts by weight of calcium hydroxide.

The percentage of binder indicated in tables 1, 2 and 3 is the percentage by weight of the binder mix, based on the weight of sand.

Various curing agents were used in the examples. These include glycerol triacetate, which is designated in tables 1 and 2 as Tri. Another curing agent used was ethylene glycol diacetate. This is designated in the tables as E.G.D.A. A further curing agent used was butylene 1,3 glycol diacetate. This is designated in the tables as B.G.D.A. A further curing agent used was propylene 1,2 glycol diacetate. This is designated in the tables as P.G.D.A. In further examples, there was used a blend of the dimethyl esters of adipic, glutaric and succinic acids which is supplied by ICI Chemicals & Polymers Limited under the designation Stabgel R. This blend is designated in the tables as Stabgel.

In tables 1,2 and 3, the weight of the resin mix used is stated as a percentage of the weight of the sand. The weight of the curing agent used is stated as a percentage of the weight of the resin mix used.

Example 1 shows that quite a high strength can be attained by using the binder in a portion of 4.4% of the weight of sand. Using the substantially lower proportion of binder indicated in example 2 results in satisfactory strengths. These examples show that use of the present invention can achieve core strengths which are not inferior to those achieved by use of commercially available alkaline phenolic resin binders cured by esters.

In examples 4 to 7, the results achieved with different proportions of the metallic hydroxides and calcium citrate are compared, the identity of the curing agent and proportion of the curing agent being maintained constant. Example 7 shows that with only 9% of the binder mix constituted by the metallic hydroxides and calcium citrate, satisfactory curing of the binder is not achieved. However, the other examples show that satisfactory strengths can be attained when the proportion of metallic hydroxides and calcium citrate in the binder mix is as low as 17%. Accordingly, the binder mix used in examples 8 to 11 comprises 20% by weight of the metallic hydroxides and calcium citrate, considered collectively.

Examples 8 to 11 show the effect of varying the proportion of curing agent. These examples show that, in the case of the particular curing agent triacetin, an amount of the curing agent which is 12% of the weight of the resin mix used achieves a core strength which is substantially the same as that achieved with a higher portion of the curing agent. Accordingly, the amount of curing agent used in examples 12 to 19 was 13%, based on the weight of binder mix.

Examples 12 to 19 illustrate the results obtained with different curing agents. These examples illustrate that various set times can be attained by selection of an appropriate curing agent. However, example 19 shows that use of triacetin from a batch other than the batch used in earlier examples resulted in premature curing of the mixture before specimen cores could be produced. A curing agent formed by mixing triacetin from this batch with BGDA enabled a satisfactory benchlife to be attained.

In examples 30 and 31, there is used a weight of a binder mix equal to 2.1% of the weight of sand. In both of these examples, the curing agent used was a blend of PGDA (75 parts) and BGDA (25 parts by weight), the proportion of curing agent being 15% of the weight of binder mix. In example 30, the specimen cores were left open to the ambient atmosphere after they had been stripped from their moulds. In example 31, the specimen cores were stripped from the moulds and immediately sealed in polyethylene bags containing carbon dioxide. The compression strengths measured after twenty four hours show that subjecting the specimen cores to a relatively high concentration of carbon dioxide impairs the core strength significantly. However, substantial core strength is maintained.

Example 32 differs from example 31 only in that, after stripping from their moulds, the specimen cores were maintained under conditions of 100% relative humidity. The compressive strength measured after twenty four hours is significantly lower than that measured in example 30 but shows that the reduction in strength resulting from the high humidity is much less than one half of the strength achieved in example 30.

Example 28 shows the core strength attained after subjecting a specimen to a high concentration of carbon dioxide in the manner hereinbefore described with reference to example 31. Example 29 shows the core strength attained with a specimen which is subjected to 100% relative humidity in the manner hereinbefore described with reference to example 32. Example 27 shows the strength achieved when the specimen cores are stored in a humid cabinet, after ejection from their moulds. In of examples 27,28 and 29, the binder mix, was the same as used in example 6. The curing agent used was triacetin and the proportion of this was 10% of the weight of binder mix. There was incorporated in the binder mix used in examples 27,28 and 29 known additives used in binder compositions cured by gasing with carbon dioxide, these compositions comprising calcium hydroxide and aqueous sodium polyacrylate. These additives are intended to provide protection against degradation of the core by relatively high levels of carbon dioxide and/or humidity. These additives were not present in the compositions used in examples 30,31 and 32. Comparison of the strengths achieved in these examples with those achieved in examples 27,28 and 29 indicates that use of the present invention may enable use of these additives to be avoided, even when cores are likely to be subjected to relatively high concentrations of carbon dioxide and/or high relative humidity.

Specimen cores have also been prepared using the constituents of some of the examples set out in tables 1 and 2, with the exception that magnesium oxide was substituted for the magnesium hydroxide, but by the alternative procedure of mixing the curing agent with the sand for one minute, then adding the aqueous solution of sodium polyacrylate and mixing for one further minute and then adding the calcium hydroxide, magnesium hydroxide and calcium citrate as a mixture of powders. Mixing was continued for one further minute and the specimen cores then formed. The compression strengths of the resulting cores were found to be inferior to those attained in the corresponding examples set out in tables 1 and 2.

Curing of the shaped mixture may be promoted by gasing with a further ester, for example methyl formate, or with an acidic gas, for example carbon dioxide.

TABLE 1

| | BINDER MIX | | CURING AGENT | | SET | COMPRESSION STRENGTH | | | | |
|---|---|---|---|---|---|---|---|---|---|---|
| EXAMPLE | Type | % | Type | % | TIME | 1 hr | 2 hr | 3 hr | 24 hr | 24 HR HARDNESS |
| 1. | A | 4.4 | Tri | 10 | 7 | 26.7 | 30.5 | 33.7 | 61.9 | 93/86 |
| 2. | A | 3.2 | Tri | 10 | 10 | 15.2 | 18.4 | 21.7 | 39.3 | 82/77 |
| 3. | A | 3.2 | Tri | 10 | 6 | 14.9 | 19.1 | 20.4 | 44.2 | 85/75 |
| 4. | D | 3.0 | Tri | 10.7 | 6 | 13.5 | 19.5 | 22.1 | 46.7 | 89/78 |
| 5. | E | 2.8 | Tri | 11.4 | 5 | 15.5 | 20.9 | 22.9 | 45.9 | 91/73 |
| 6. | F | 2.6 | Tri | 12.3 | 10 | 13.5 | 18.3 | 20.0 | 41.4 | 85/79 |
| 7. | G | 2.4 | Tri | 13.3 | | | — | — | — | — |
| 8. | C | 2.7 | Tri | 8 | 15 | 5.8 | 9.9. | 12.4 | 32.2 | 80/65 |
| 9. | C | 2.7 | Tri | 10 | 9 | 6.8 | 11.7 | 15.8 | 35.8 | 84/69 |
| 10. | C | 2.7 | Tri | 12 | 7 | 13.9 | 18.2 | 20.6 | 39.0 | 79/69 |
| 11. | C | 2.7 | Tri | 15 | 7 | 14.1 | 16.8 | 19.0 | 39.2 | 75/65 |
| 12. | B | 2.4 | Stabgel | 13 | 20 | 9.9 | 14.5 | 17.6 | 37.2 | 84/80 |
| 13. | B | 2.4. | PGDA | 13 | 9 | 16.8 | 21.4 | 23.9 | 35.2 | 80/80 |
| 14. | B | 2.4 | PGDA:BGDA 50:50 | 13 | 18 | 14.4 | 20.5 | 22.2 | 40.4 | 83/77 |
| 15. | B | 2.4 | PGDA:BGDA 75:25 | 13 | 14 | 16.4 | 20.5 | 21.9 | 41.5 | 80/76 |

TABLE 2

| | BINDER MIX | | CURING AGENT | | SET | COMPRESSION STRENGTH | | | | |
|---|---|---|---|---|---|---|---|---|---|---|
| EXAMPLE | Type | % | Type | % | TIME | 1 hr | 2 hr | 3 hr | 24 hr | 24 HR HARDNESS |
| 16. | B | 2.4 | Tri:BGDA 25:75 | 13 | 24 | 12.7 | 17.9 | 21.4 | 35.3 | 79/74 |
| 17. | B | 2.4 | BGDA | 13 | 54 | 4.3 | 16.0 | 19.1 | 41.3 | 83/80 |
| 18. | B | 2.4 | EGDA | 13 | 4 | 15.8 | — | — | 32.9 | 61/60 |
| 19. | B | 2.4 | Tri | 13 | Bench Life less than 1 min. | | Not measured. — | — | — | — |
| 20. | B | 2.4 | Tri:BGDA 25:75 | 13 | 53 | 2.5 | 9.8 | 13.8 | 29.5 | 71/59 |
| 21. | B | 2.4 | Tri:BGDA 25:75 | 13 | 24 | 12.7 | 17.9 | 21.4 | 35.3 | 79/74 |
| 22. | B | 2.4 | Tri:BGDA 25:75 | 13 | 23 | 13.4 | 19.0 | 21.7 | 39.4 | 76/69 |
| 23. | B | 2.4 | Stabgel | 13 | 20 | 9.9 | 14.5 | 17.6 | 37.2 | 84/50 |
| 24. | B | 2.4 | Stabgel R | 13 | — | — | — | — | 23.7 | 72/68 |
| 25. | B | 2.4 | Stabgel | 13 | — | — | — | — | 19.6 | 63/57 |

TABLE 3

| | BINDER MIX | | CURING AGENT | | SET | COMPRESSION STRENGTH | | | | |
|---|---|---|---|---|---|---|---|---|---|---|
| EXAMPLE | Type | % | Type | % | TIME | 1 hr | 2 hr | 3 hr | 24 hr | 24 HR HARDNESS |
| 26. | B | 2.4 | Stabgel | 13 | Very stiff/dry mix here | — | — | — | 8.4 | 43/42 |
| 27. | F | 2.6 | Tri | 10 | 10 | 13.5 | 18.3 | 20.0 | 41.4 | 85/79 |
| 28. | F | 2.6 | Tri | 10 | — | — | — | | 22.3 | 58/50 |
| 29. | F | 2.6 | Tri | 10 | — | — | — | | 23.7 | 66/61 |
| 30. | I | 2.1 | PGDA:BGDA 75:25 | 15 | 14 | 16.3 | 19.3 | 22.6 | 27.5 | 71/63 |
| 31. | I | 2.1 | PGDA:BGDA 75:25 | 15 | | — | — | | 11.3 | 51/42 |
| 32. | I | 2.1 | PGDA:BGDA 75:25 | 15 | — | — | — | | 19.2 | 63/58 |

What we claim is:

1. A method of curing a binder comprising a source of polyvalent cations and a source of anions from polymeric organic acids, wherein a curing agent in liquid form comprising an ester is mixed with the binder.

2. A method according to claim 1 wherein the curing agent is selected from the group consisting of liquid esters and liquid mixtures of esters.

3. A method according to claim 1 wherein the source of polyvalent cations, the source of anions and the curing agent are mixed with a foundry aggregate, the mixture is formed into a required shape and the mixture is permitted to cure.

4. A method according to claim 3 wherein, after forming the mixture into the required shape a further curing agent is passed into the formed mixture.

5. A method according to claim 1 wherein the source of polyvalent cations comprises a compound selected from the group consisting of oxides and hydroxides of metals.

6. A method according to claim 5 wherein the source of polyvalent cations comprises calcium hydroxide and a compound selected from the group consisting of oxides and hydroxides of metals other than calcium.

7. A method according to claim 3 wherein the curing agent is mixed with the foundry aggregate before the binder is mixed with the foundry aggregate and curing agent.

8. A foundry composition comprising a foundry aggregate, a source of polyvalent cations, an ester which is a liquid at ambient temperature and a source of anions from polymeric organic acids.

9. A liquid binder composition comprising a source of polyvalent cations, an ester and a source of anions from polymeric organic acids, which composition will remain in a flowable condition for more than one minute.

10. A composition according to claim 9 wherein the source of polyvalent cations comprises calcium hydroxide and a compound selected from the oxides and hydroxides of polyvalent metals other than calcium.

11. A consignment comprising at least first and second separate compositions, wherein the first composition comprises a source of anions from polymeric organic acids, wherein the second composition comprises an ester in liquid form and wherein one of the compositions comprises a source of polyvalent cations.

12. A consignment according to claim 10 wherein said composition which comprises a source of polyvalent cations is an aqueous composition.

* * * * *